US006400328B1

(12) United States Patent
Falk

(10) Patent No.: US 6,400,328 B1
(45) **Date of Patent: *Jun. 4, 2002**

(54) SCANNING CONTINUOUS LENS ANTENNA DEVICE

(75) Inventor: Kent Olof Falk, Mölnlycke (SE)

(73) Assignee: Telefonaktiebolaget LM Ericsson (publ), Stockholm (SE)

( * ) Notice: Subject to any disclaimer, the term of this patent is extended or adjusted under 35 U.S.C. 154(b) by 0 days.

This patent is subject to a terminal disclaimer.

(21) Appl. No.: 09/717,066

(22) Filed: Nov. 22, 2000

(30) Foreign Application Priority Data

Nov. 23, 1999 (SE) ..... 9904234

(51) Int. Cl.[7] ..... H01Q 19/06

(52) U.S. Cl. ..... 343/757; 343/754

(58) Field of Search ..... 343/757, 754, 343/755, 753, 783, 909, 911 R, 912, 785, 787; H01Q 19/06

(56) References Cited

U.S. PATENT DOCUMENTS

| | | | | | |
|---|---|---|---|---|---|
| 3,631,501 | A | * | 12/1971 | Buscher | 343/754 |
| 4,636,799 | A | | 1/1987 | Kubick | 343/754 |
| 4,706,094 | A | | 11/1987 | Kubick | 343/754 |
| 5,212,583 | A | | 5/1993 | Vali e al. | 359/245 |
| 5,472,935 | A | | 12/1995 | Yandrofski et al. | 505/210 |
| 6,037,904 | A | * | 3/2000 | Cheng et al. | 343/700 MS |
| 6,160,524 | A | * | 12/2000 | Wilber | 343/787 |
| 6,159,059 | A1 | * | 2/2001 | Falk | 343/754 |
| 6,326,931 | B1 | * | 12/2001 | Falk | 343/757 |

FOREIGN PATENT DOCUMENTS

| | | |
|---|---|---|
| WO | 93/10571 | 5/1993 |
| WO | 00/33416 | 6/2000 |
| WO | 00/33417 | 6/2000 |

OTHER PUBLICATIONS

Application for 09/717,001 filed Nov. 22, 2000, corresponding to Swedish Patent Application 9904235–0.

* cited by examiner

*Primary Examiner*—Don Wong
*Assistant Examiner*—Trinh Vo Dinh
(74) *Attorney, Agent, or Firm*—Burns, Doane, Swecker & Mathis, L.L.P.

(57) ABSTRACT

A method and a device is disclosed for the generation of a lens device including a plate of ferroelectric material, the transmission phase gradient of which is be varied over the lens by means of a controllable static electric field. The division of an aperture will depend on the number of degrees of freedom to be controlled simultaneously. According to the present invention an electromagnetically transparent highly resistive film (24, 34) is applied at both sides of a plate presenting ferroelectric properties. At two opposite edges of these resistive films highly conducting wires (22, 23 and 32, 33) are applied and electrically connected along the resistive film. The pairs of highly conductive wires at the opposite edges of each one of the two films on the plate presenting the ferroelectric properties are running perpendicular to each other. The first pair of highly conducting wires running parallel to the y-axis is connected to a variable voltage source ($U_x$) (26), while the second pair of highly conducting wires parallel to the x-axis is connected to a second variable voltage source ($U_y$) (36). In this way a lobe may be steered in the X-Z plane by $U_x$ and in the Y-Z plane by $U_y$. In order to obtain low losses and no change of the controlling E field polarity when sweeping the voltage sources, a bias source of the order several hundreds of volts is applied between the two voltage sources.

6 Claims, 3 Drawing Sheets

SCANNING CONTINUOUS LENS ANTENNA DEVICE

TECHNICAL FIELD

The present invention relates to a continuous scanning lens antenna device, and more exactly to a method and a device providing control of the direction of a main lobe or lobes of a scanning antenna without mechanically moving the antenna.

BACKGROUND

Sometimes it is desirable to be able to quickly change radiation direction of an antenna. In other words the antenna lobe is to be quickly shifted or swept between different directions. The demand regarding time is often such that an arrangement for mechanical motions of the antenna is not feasible.

Today antenna arrays are used which contain elements in which a signal phase at each element may be individually set to achieve a control of the main direction of the antenna lobe. Another technique to achieve a control of a radiation lobe is to utilize what is normally referred to as an "optical phased array", which includes an adaptable lens which, for instance, is disclosed in a document U.S. Pat. No. 5,212,583. This document describes a device utilizing a single plate of a material presenting ferroelectric properties. In a second embodiment disclosed the ferroelectric plate is provided with a ground-plane on one side and two orthogonal grids on the other side for radiation lobe control. Both the grids and the ground-plane are made in a light transparent material, indium/tin oxide. This document only refers to optical systems and does not discuss whether this is applicable to the microwave range.

However, in a microwave system, when the wavelength of an electro-magnetic wave generally is much larger than the distance between conducting grid wires, it should be noted that only a grid wire direction-being perpendicular to the E-field vector of the propagating wave can be utilized for controlling the refractive index of the ferroelectric plate. A grid wire direction parallel to the E field vector will result in a reflection of the electromagnetic wave. In the disclosed optical system the grid conductor wire distances are expected to be much larger than the wavelength of the light, i.e. $\lambda \ll$wire separation. Besides a conducting ground-plane will totally reflect the propagating microwave.

Two documents U.S. Pat. Nos. 4,706,094 and 4,636,799 both disclose a ferroelectric block between grids of parallel wires. According to the first document only controlling fields are used across the block, i.e. in the propagation direction of the wave. According to the other document the voltages at the wires are arranged such that the field may adopt arbitrary directions in the plane perpendicular to the wires. In the first document it is pointed out that the "normally" high conductive wires only transmits perpendicular, linear polarization but that they may be replaced by resistive wires being able to transmit also parallel polarization at some loss.

WO,A1,93/10571 demonstrates a development of U.S. Pat. No. 4,636,799 where only fields perpendicular to the wires are used. Here only one layer of wires is needed and the ferroelectric material has been divided into a plurality of blocks such that the grid of wires can be disposed in the middle of the ferroelectric layer.

However it will be noted that, the documents cited above are addressing the use of highly conductive wires and a voltage gradient is then achieved by applying different voltages to the individual wires according to a given pattern. Furthermore the devices described are related to utilizing the ferroelectric material for "electro-optic lenses" which primarily directs the utilization to frequencies corresponding to electromagnetic radiation in the nanometer range.

Furthermore none of the documents has disclosed a device being able to scan microwave radiation in two orthogonal planes in a single ferroelectric plate. Neither it has been shown that this can be done by using several layers of ferroelectric material without large losses.

Therefore there is still a demand for a method and a device, which will operate even at a much lower frequency range, i.e., in the microwave range.

SUMMARY

The present invention discloses a method and a device for the generation of a lens device including a plate of ferroelectric material, the transmission phase gradient of which is varied over the surface of the lens by means of controllable static electric fields. The lens may involve an entire antenna aperture, e.g. a feeder horn or constitute a surface covering a slotted waveguide antenna, be a portion of a microwave antenna aperture or an element in a conventional microwave array aperture. The division of the aperture depends on the number of degrees of freedom to be controlled simultaneously. In a general case N lobes and M nulls are to be controlled at the same time. In the most simple case with N=1 and M=0 the lens will cover the entire antenna aperture.

According to the present invention an electromagnetically transparent highly resistive film is applied at both sides of a plate presenting ferroelectric properties. At two opposite edges of these resistive films highly conducting wires are applied and electrically connected along the resistive film. The pairs of highly conductive wires at the opposite edges of each one of the two films on the plate presenting the ferroelectric properties are running perpendicular to each other. The first pair of highly conducting wires parallel to the y-axis is connected to a variable voltage source ($U_x$), while the second pair of highly conducting wires parallel to the x-axis is connected to a second variable voltage source ($U_y$). In this way a lobe may be steered in the X-Z plane by $U_x$ and in the Y-Z plane by $U_y$. In order to obtain low losses and no change of the controlling E field polarity when sweeping the voltage sources, a bias source of the order several hundreds of volts is applied between the two voltage sources. Another benefit of the present design is that it will operate independent of the polarization of the passing microwave power.

A method according to the present invention is set forth by the attached independent claim 1 and by the dependent claims 2 to 3.

Similarly a continuous scanning lens antenna device according to the method of the present invention is set forth by the attached independent claim 4 and further embodiments are defined in the dependent claims 5 to 6.

BRIEF DESCRIPTION OF THE DRAWINGS

The invention, together with further objects and advantages thereof, may best be understood by making reference to the following description taken together with the accompanying drawings, in which.

DETAILED DESCRIPTION

Example of Embodiments

Figure 1:
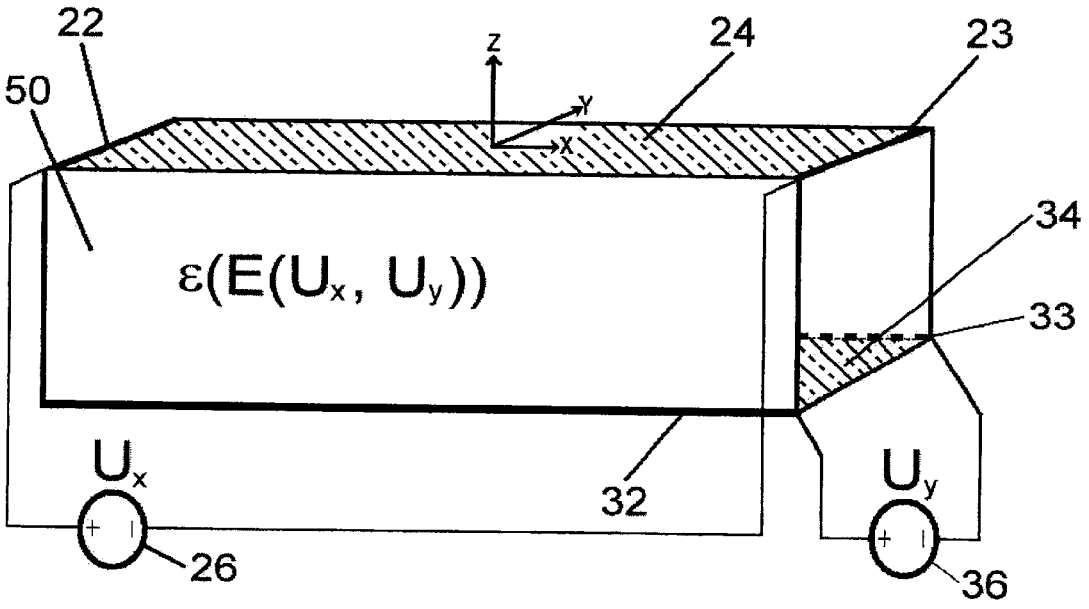
FIG. 1 is a sketch, which illustrates the principle according to the present invention.

In a material presenting ferroelectric properties the dielectric properties will change under the influence of an electric field. This will be further discussed below in connection to a description of lobe control. Such a change of the dielectric properties of a ferroelectric plate will be utilized for creating a controllable continuous scanning lens antenna. The antenna aperture or a portion of an aperture may be built up by means of a lens element having an electromagnetically transparent highly resistive (low conductivity) film layer on each side of a plate made from a material presenting ferroelectric properties. This film layer has to be thin, preferably of the order 1 to 10 $\mu$m, and transparent to an electromagnetic wave in a range, for instance, 30 to 60 GHz and presents a very high resistance for instance of the order 500 MΩ/sqr. By forming a continuous resistive surface an electrostatic potential created across the surface of the film will be homogeneously distributed. By making the film very thin and a very high surface resistance a power loss of a passing electromagnetic wave can be minimized. At two opposite edges of each one of the two layers of resistive transparent film two highly conducting wires 22, 23 respectively 32, 33 are connected along the respective edge and electrically connected to the respective voltage terminals of variable voltage sources. In this way a static electric field will be created over the highly resistive film layer perpendicular to the respective two edge-wires, and a phase gradient will be achieved across the plate if an electric field having a suitable gradient in this way is applied across the plate presenting the ferroelectric properties.

The static electric fields in the X and Y directions will be achieved by means of the two separate layers resistive films. One layer of highly resistive film 24 being positioned at a first side of the plate 50 made of a material presenting the ferroelectric properties and the other layer of resistive film 34 being positioned at the second side of the plate presenting ferroelectric properties.

A variable voltage source ($U_x$) 26 is connected across the resistive film 24 by means of the highly conducting wires 22 and 23 and a voltage potential gradient will be distributed over the entire first film 24.

Figure 2:
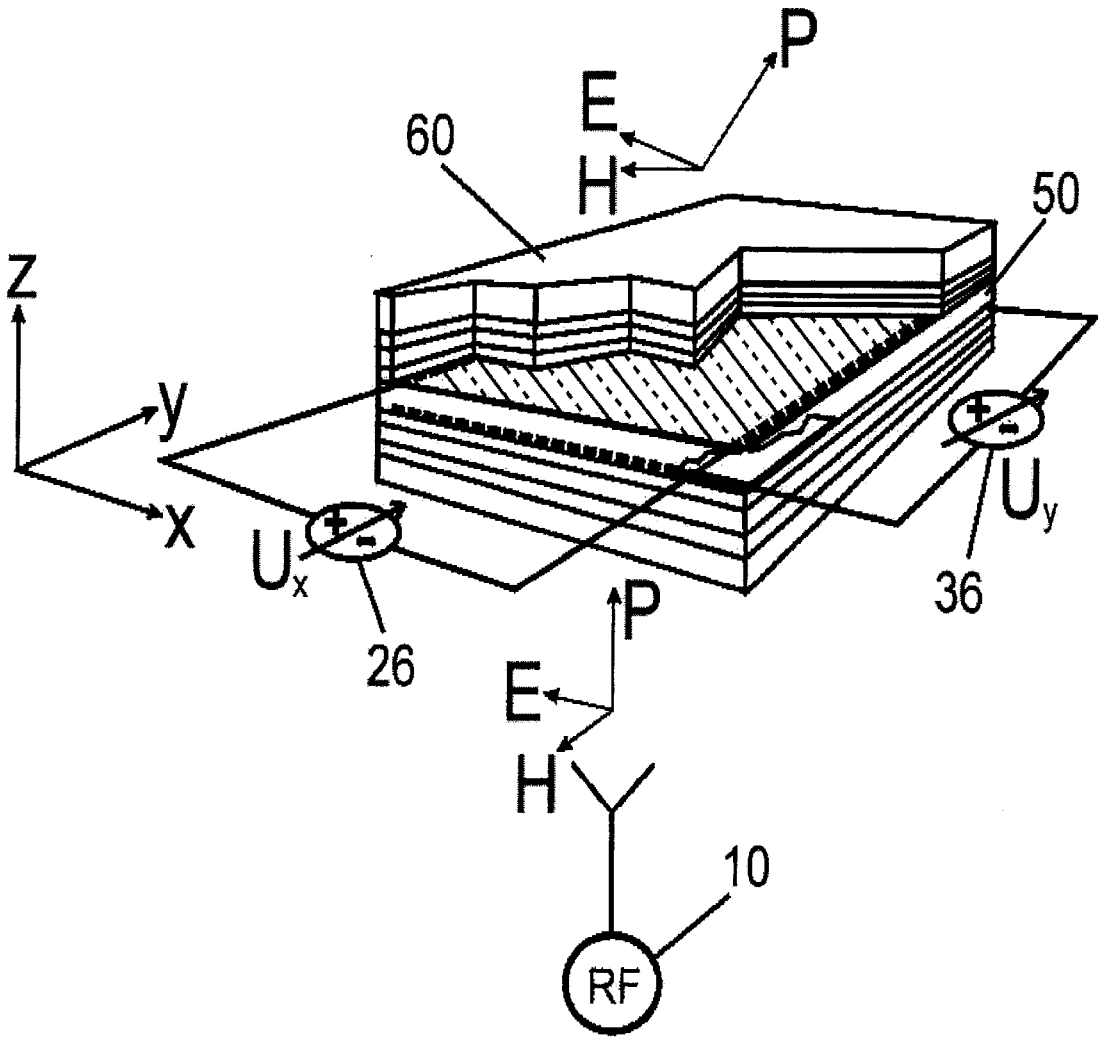
FIG. 2 illustrates an embodiment of a scanning lens element according to the principle shown in FIG. 1.

A second variable voltage source ($U_y$) 36 is connected to the wires 32 and 33, and consequently across the second resistive film 34. Due to the voltage applied across the resistive film 34 an electric potential gradient will then be created in the Y direction. Now, as is indicated in FIG. 2, the lobe of the antenna having the continuous scanning lens can by means of $U_x$ be controlled in the X-Z plane and by $U_y$ in the Y-Z plane. In FIG. 2 E represents the electric field vector and H the magnetic field vector of the propagating wave from the RF source. P represents the propagation vector (or Poynting vector). However it should be noted that the operation of the present design will independent of the polarization of the microwave passing through the lens device. Thus, the polarization may be circular or linear at any arbitrary angle relative to the coordinate system for instance indicated in FIGS. 1 and 2.

Figure 3:
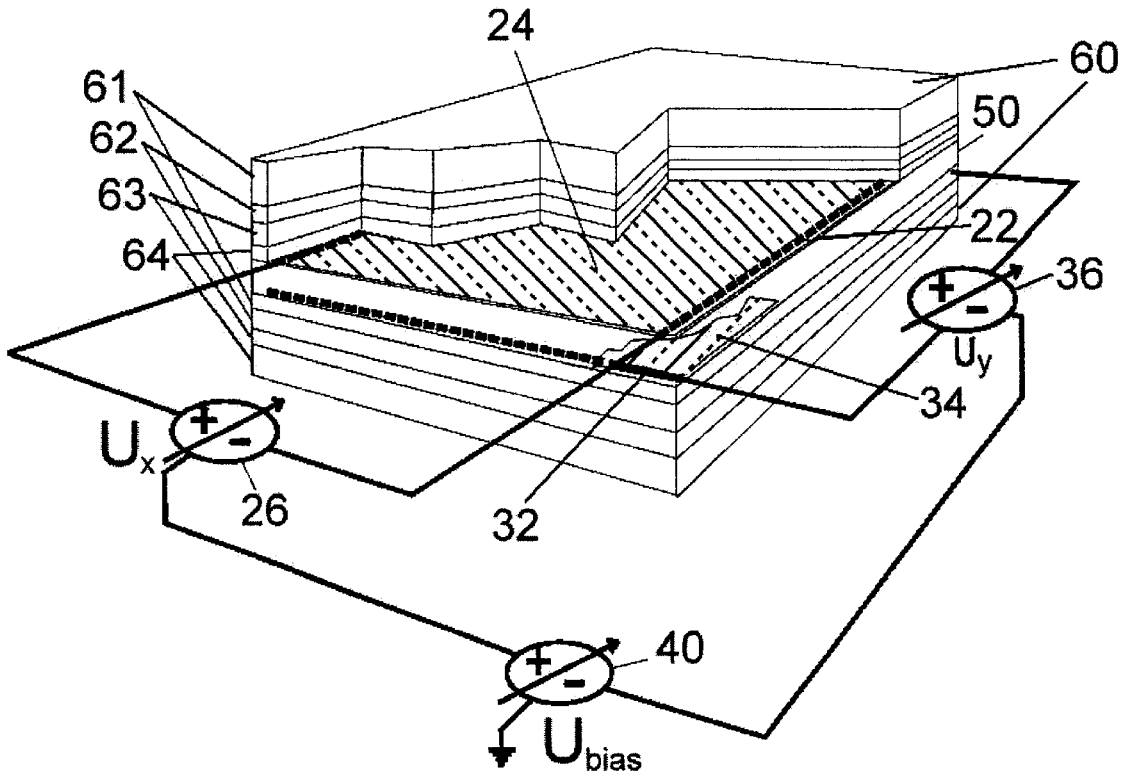
FIG. 3 is a more detailed view of the embodiment of the scanning illustrated in FIG. 2 and including a transformer device on each side of the scanning lens.

Further, similarly to FIG. 2, FIG. 3 demonstrates the structure of the continuous scanning lens, which will control an antenna lobe in the X-Z plane by means of the voltage $U_x$ and in the Y-Z plane by means of the voltage $U_y$. In order to obtain low losses and no change of E field polarity when sweeping the voltages $U_x$ and $U_y$, a bias source 40 ($U_{bias}$) of the order 5 to 10 kV is applied between the two voltage sources 26 and 36 for the X and Y direction, respectively. The symbols shown simply indicate that the bias is connected within the voltage range of the variable sources, preferably at a center point. In a similar manner it is indicated by the grounding at the symbol of the bias source how the device of the illustrative embodiment is referenced to a system ground.

To achieve an impedance matching to the surroundings, it will in most of the cases be necessary to cover the surface of the lens element on one side or on both sides with a transformer 60. This transformer changes, step by step or continuously, the impedance level such that the reflections, when the propagating wave enters or leaves the ferroelectric plate 50, become low enough within the operative frequency range. It is also possible to have the step by step or continuous change of impedance even entering into the ferroelectric material.

FIG. 3 demonstrates a more detailed embodiment of a scanning lens element according to the present invention. A typical desired frequency range for an antenna including the lens element according to the present invention may be of the order 30–40 GHz. In the illustrative embodiment the lens element includes a flat slice 50 of the material presenting the ferroelectric properties.

In this embodiment the material presenting the ferroelectric properties may be in the form of a flat square slice 50 having measures of about 10×10 cm and a thickness of about 0.5 cm. For instance, typical such materials are barium titanate, barium strontium titanate or lead titanate in fine grained random polycrystalline or ceramic form. A suitable ceramic, for instance made available on the market by Paratek Inc., Aberdeen, Md., USA, is a material identified as Composition 4, which presents a relative dielectric constant $\in_r (E_{DC}=0)=118$ and with a tunability of 10% according to the specification. This lens plate may for instance be positioned in connection to a feeder horn, cover a slotted wave-guide antenna, or as an element in a conventional array aperture.

Furthermore, on the top and/or the bottom of the slice 50 of the lens element there can be arranged an impedance transformer 60 to obtain an impedance matching for the present lens element, which may represent an impedance value of the order of 40 ohms. In the embodiment illustrated in FIG. 3 there is an impedance transformer onto each side of the lens element. In this illustrative embodiment both transformers consist of a number of layers 61, 62, 63 and 64 of dielectric material presenting a stepwise change of the dielectric constant for a stepwise matching of the impedance of the lens element to the surroundings (e.g. free air≈377 ohms). If the lens element for instance is combined with a slot antenna there may be a need for only one transformer at the side facing air.

Description of Lobe Control

If $U_x=U_y=0$ the antenna lobe will coincide with the surface normal surface of the flat lens element being illuminated by an incident field perpendicular to the flat lens element. When for instance $U_x$ and $U_y$ are changed to $U_{xo}$ and $U_{yo}$, respectively, it will be created a static electric field E over the material presenting the ferroelectric properties in accordance to:

$$E(x,y)=(U_{xo}\cdot x/x_a-U_{yo}\cdot y/y_a+U_{bias})/d \quad (1)$$

d then representing the thickness of the material presenting the ferroelectric properties, $y_a$ representing the extension of the plate in the Y direction of the aperture and $x_a$ representing its extension in the X direction. If $\in$ lies within a range being approximately linear as a function of E the dielectric constant (permittivity) will vary over the surface according to:

$$\in(x,y)\cong\in(U_{bias})-C\cdot E(x,y) \quad (2)$$

This results in a phase gradient over the surface for the transmitted wave according to:

$$\Delta\phi(x,y)=(2\pi d/\lambda_0)\cdot\sqrt{\in(x,y)} \quad (3)$$

The lobe will approximately point to the direction of the surface normal of the phase gradient in the middle of the aperture (x=y=0). The angle $\Phi_x$ between the axis Z and the projection of the lobe onto the plane X-Z will approximately become:

$$\Phi_x=a\ \tan(d/dx(\Delta\phi(x,y))|_{x=y=0}\cdot(\lambda_0/(2\pi))) \quad (4)$$

In an analogue way the angle $\Phi_y$ between the axis Z and the projection of the lobe onto the plane X-Y becomes approximately:

$$\Phi_y=a\ \tan(d/dy(\Delta\phi(x,y))|_{x=y=0}\cdot(\lambda_0/(2\pi))) \quad (5)$$

Consequently a full lobe control will simply be obtained in both of the planes X-Z and Y-Z. A change of lobe direction is instantaneously obtained with a change of the applied electric voltages feeding the respective film.

It will be understood by those skilled in the art that various modifications and changes may be made to the present invention without departure from the scope thereof, which is defined by the appended claims.

What is claimed is:

1. A method for obtaining a continuous scanning lens antenna comprising the steps of:

arranging a lens element in the form of a plate of a material presenting ferroelectric properties;

arranging a first electromagnetically transparent, highly resistive film onto a first side of the plate of material presenting ferroelectric properties, said first highly resistive film at two opposite edges provided with a first highly conductive wire and a second highly conductive wire electrically connected along the respective opposite edge;

arranging a second electromagnetically transparent, highly resistive film onto a second side of the plate of material presenting ferroelectric properties, said second highly resistive film at two opposite edges provided with a third highly conductive wire and a fourth highly conductive wire electrically connected along the respective opposite edge, said third and fourth wires of the second film running perpendicular to said first and second wires of said first highly resistive film;

connecting a first variable voltage source Ux to said first and second conductive wires of said first resistive film forming a static potential gradient across said first highly resistive film, and connecting a second variable voltage source Uy to said third and fourth highly conductive wires of said second resistive film to create a static potential gradient across said second highly resistive film, thereby forming perpendicular static E-fields across the plate;

illuminating one side of the plate of material presenting ferroelectric properties with a microwave field of an arbitrary polarization, controlling the dielectric constant across the surface of the lens element by controlling the voltages of said first and the second voltage sources to thereby control a direction of an antenna lobe generated by refracted microwave power by means of the scanning lens antenna.

2. The method according to claim 1, comprising the further step of arranging a biasing voltage $U_{bias}$ between said first and second electromagnetically transparent highly resistive films, or the first and second voltage sources, to obtain low loss operation and to guarantee no change of a static E-field polarity.

3. The method according to claim 1, comprising the further step of arranging an impedance matching to the surroundings by covering the at least one surface of the lens element with a transformation device which, step by step or continuously, changes the impedance such that a coupling to the surroundings becomes sufficiently high within an operative frequency range of the antenna.

4. A continuous scanning antenna lens device comprising a lens element in the form of a plate of a material presenting ferroelectric properties;

a first electromagnetically transparent, highly resistive film onto a first side of the plate of material presenting ferroelectric properties, said first highly resistive film at two opposite edges provided with a first highly conductive wire and a second highly conductive wire electrically connected along the respective opposite edge;

of the a second electromagnetically transparent, highly resistive film onto a second side of the plate of material presenting ferroelectric properties, said second highly resistive film at two opposite edges provided with a third highly conductive wire and a fourth highly conductive wire electrically connected along the respective opposite edge, said third and fourth wires of said second highly resistive film then running perpendicular to said first and second wires of said first highly resistive film; and wherein a first variable voltage source Ux is connected to said first and second conductive wires of said first electromagnetically transparent resistive film forming a static potential gradient across said first resistive film, and a second variable voltage source Uy is connected to said third and fourth highly conductive wires of said second electromagnetically transparent resistive film to create a static potential gradient across said second resistive film, thereby forming perpendicular static E-fields across the plate; and one side of the plate of material presenting ferroelectric properties being illuminated with a microwave field of an arbitrary polarization, whereby a dielectric constant across the surface of the lens element is controlled by means of the voltage of said first and the second voltage sources and thereby controlling a direction of an antenna lobe generated by refraction of microwave power passing through the scanning antenna lens device.

5. The device according to claim 4, wherein a biasing voltage $U_{bias}$ is arranged between said first and second electromagnetically transparent resistive films to obtain low loss operation and to guarantee no change of a static E-field polarity.

6. The device according to claim 4, comprising an impedance matching the surroundings in the form of a transformation device covering at least one surface of the lens element, which transformation device, step by step or continuously, changes the impedance level such that the coupling to a surrounding medium becomes sufficiently high within an operative frequency range of the scanning antenna lens device.

* * * * *